US005160016A

United States Patent [19]

Moksnes

[11] Patent Number: 5,160,016

[45] Date of Patent: Nov. 3, 1992

[54] FEED HOPPER AGITATOR

[75] Inventor: Stephen L. Moksnes, Whitewater, Wis.

[73] Assignee: AccuRate, Inc., Whitewater, Wis.

[21] Appl. No.: 821,219

[22] Filed: Jan. 16, 1992

[51] Int. Cl.[5] ..... B65G 47/20

[52] U.S. Cl. ..... 198/533; 198/671; 222/203

[58] Field of Search ..... 198/533, 671, 550.2; 222/198, 203

[56] References Cited

U.S. PATENT DOCUMENTS

| | | | |
|---|---|---|---|
| 2,560,480 | 7/1951 | Rogers et al. | 222/203 X |
| 2,858,011 | 10/1958 | Wahl | 198/671 X |
| 4,583,901 | 4/1986 | Tyrer | 198/533 X |

FOREIGN PATENT DOCUMENTS

| | | | |
|---|---|---|---|
| 0642245 | 1/1979 | U.S.S.R. | 198/533 |
| 0662453 | 5/1979 | U.S.S.R. | 198/533 |
| 1000765 | 2/1983 | U.S.S.R. | 222/203 |
| 1265097 | 10/1986 | U.S.S.R. | 222/203 |
| 1381037 | 3/1988 | U.S.S.R. | 222/203 |
| 1525091 | 11/1989 | U.S.S.R. | 198/533 |

*Primary Examiner*—Robert P. Olszewski
*Assistant Examiner*—James R. Bidwell
*Attorney, Agent, or Firm*—Foley & Lardner

[57] ABSTRACT

A feed hopper assembly for feeding granular material to a feed screw in the bottom of the hopper, the assembly including a frame for supporting a flexible type feed hopper, one or more roller assemblies mounted on the frame in a position to engage the sides of the feed hopper, each roller assembly including a shaft and a tube mounted for rotary motion on the shaft, the shaft being eccentrically mounted on the frame to move the tube into and out of engagement with the hopper.

10 Claims, 2 Drawing Sheets

FEED HOPPER AGITATOR

FIELD OF THE INVENTION

The present invention relates to feed hoppers for granular materials and more particularly to a rotary feed hopper agitator to maintain flow of granular material through the hopper.

BACKGROUND OF THE INVENTION

It is generally known that many dry granular materials do not flow by themselves and that agitation or vibration is necessary to keep the granular materials flowing through the hopper. Vibrators of the type contemplated herein are shown in U.S. Pat. No. 1,548,385, issued on Aug. 4, 1925, to W. E. Prescott, and entitled "Feed Hopper;" U.S. Pat. No. 2,560,480, issued on Jul. 10, 1951, to W. B. Rogers, et al., and entitled "Hopper Shaker Plate And Comb Assembly;" and Russian Patent No. 1381037, issued on Mar. 15, 1988, to G. G. Zurabishvili, and entitled "Granulated Material Bunker." Vibration of hoppers of this type often cause segregation of the different size materials being fed wherein the heavier, denser materials settle in the hopper and are fed into the feed screw before the lighter material.

Internal stirring devices have also been used to keep materials from bridging over the feed screw at the bottom of the hopper. If the materials fail to flow into the flights of the feed screw an interrupter is used to break up the material on the top of the feed screw. The internal stirring devices also change the density of the material by pushing the material in the front of the stirring device until it is compacted. As the stirring device rotates around the hopper the more dense material is pushed into the flights of the feed screw. As these flights turn the next couple of flights receive the lighter material that follows immediately after the stirring device. This resulted in erratic feeding of the material making it hard to maintain feed accuracy.

In order to obtain accuracy in feeding dry materials from a volumetric screw feeder two things must be considered. First, that the flights of the screw are completely filled with a uniform density material. Second, the screw had to be turned at a constant rate with enough of a turn down ratio to be able to key in on the rate of flow one desired.

Flexible vinyl hoppers are now available which are designed for mass flow so that material "first in" is also "first out." The flexible hopper is massaged externally to keep the granular materials from bridging over the feed screw. One system for accomplishing this result uses two paddles which rest against the outside of the flexible hopper. The paddles are undulated in such a fashion so as to break any bridges and still keep the material at a constant density. This gentle form of agitation keeps the hopper from overworking and also keeps the material being fed from being broken up or degraded. The panels rest against the sides of the flexible hopper and can be set to move a maximum amount or just a small amount depending on the density and type of material to be fed through the hopper. If the material is heavy and could be easily segregated, the panels are set to move a small amount to barely keep the material moving through the feed screw. Light materials, on the other hand, have to have maximum movement so the effect of the paddles is transferred through the entire hopper. The flexible vinyl hopper concept with the outside paddles massaging material enables one to key in on the specific characteristics of the material being fed to provide for a higher degree of accuracy than ever before capable from a volumetric feeder. However, the continuing sliding motion of the paddles against the surfaces of the vinyl hopper tend to wear or rub away the vinyl, weakening the walls of the hopper.

SUMMARY OF THE PRESENT INVENTION

The present invention relates to a granular feed hopper that includes a flexible vinyl hopper which is "massaged" to maintain a steady flow rate of the granular material through the hopper. The sides of the hopper are massaged by eccentrically mounted shafts having tubes rotatably mounted thereon which roll across the surface of the hopper as the eccentric shaft rotates toward and away from the hopper. The tubes thus eliminate any frictional engagement of the shaft with the surface of the hopper. The drive shaft for the eccentrically mounted roller shaft may be biased toward the sides of the hopper to vary the amount of massaging action to correspond to the type of granular material passing through the hopper, i.e. heavyweight or lightweight material. As is generally understood lightweight materials have to be moved a farther distance to maintain proper conditioning across the hopper while heavyweight materials do not have to be moved as much. Frequency of the massaging action is also important for the same reason, i.e. some granular materials must be massaged at a higher frequency than others.

One of the principal advantages of the present invention, therefore, is to provide a massaging action on the sides of a flexible type hopper which can be adjusted to accommodate various types of granular materials.

A further advantage of the present invention is the provision of an eccentrically rotated roller shaft which massages the hopper by roller action eliminating wear of the hopper and thereby increasing the life of the hopper.

Other principal features and advantages of the invention will become apparent to those skilled in the art upon review of the following drawings, the detailed description and the appended claims.

Figure 1:
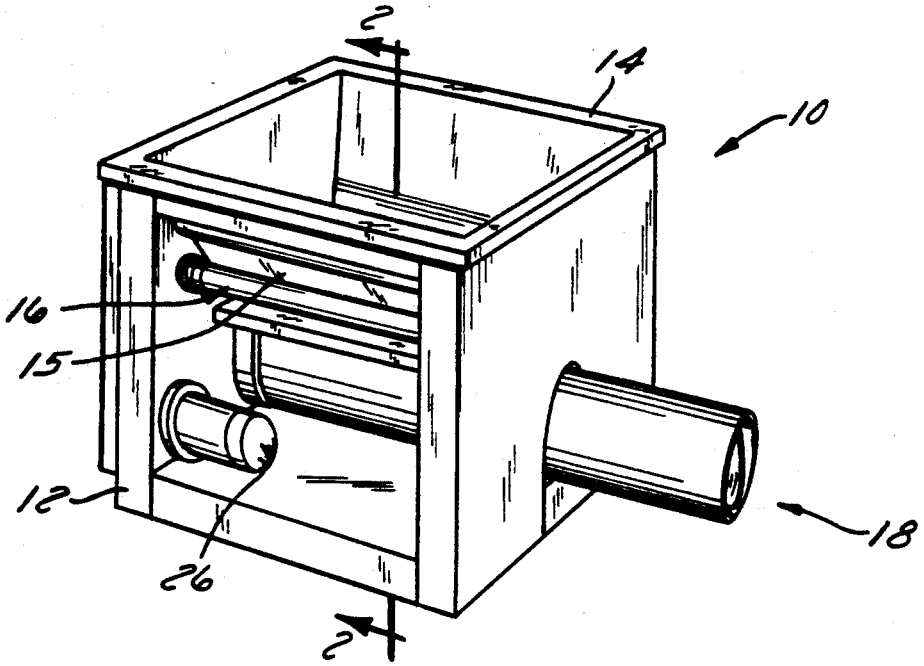
FIG. 1 is a perspective view of a hopper according to the present invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

A material feeder 10 of the type contemplated herein as shown in FIG. 1 generally includes a frame 12 for supporting a vinyl hopper 14 which is continuously massaged by eccentrically mounted roller assemblies 16. The granular material which is fed to the hopper 14 is discharged from the bottom of the hopper by a metering screw 18, the roller assemblies 16 gently massage the side walls 15 of the hopper thereby eliminating any rat holing or bridging and conditioning the material to provide a uniform bulk density as it flows into the metering screw.

Figure 2:
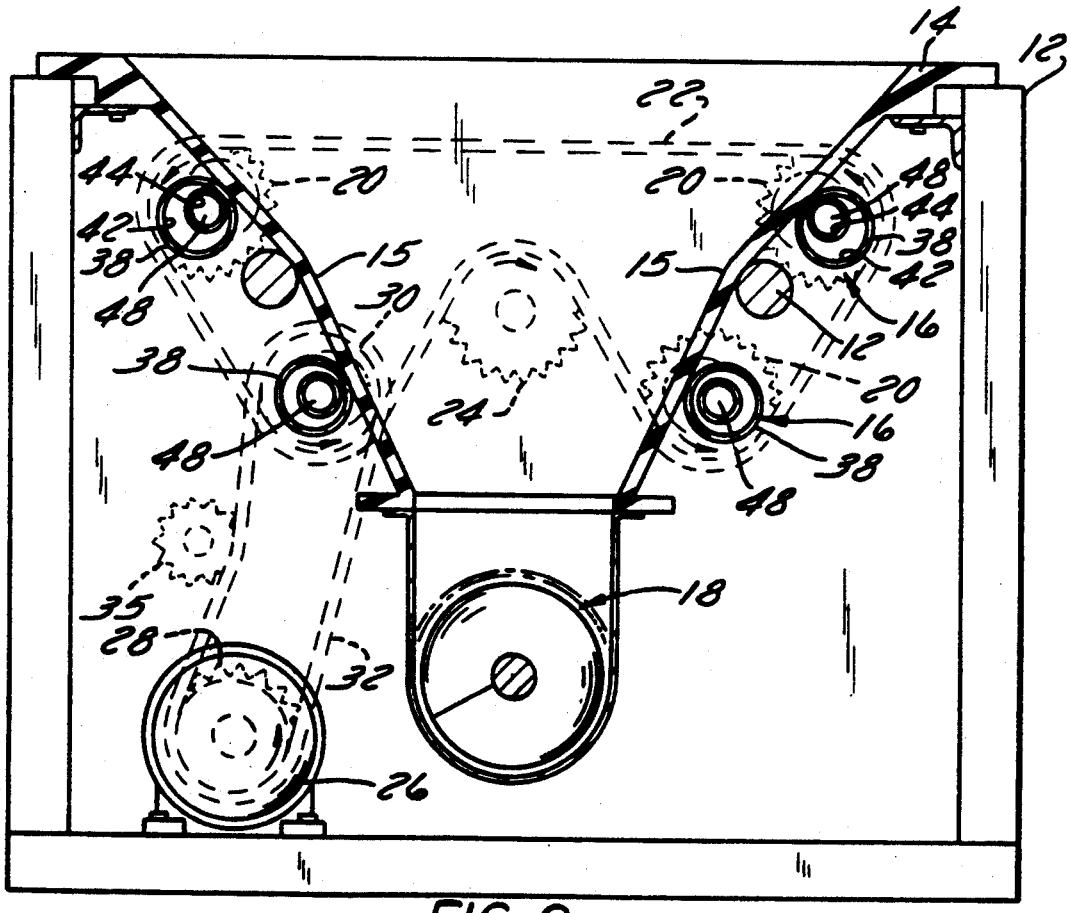
FIG. 2 is a view taken on line 2—2 of FIG. 1 showing the roller drive assembly.
Figure 3:
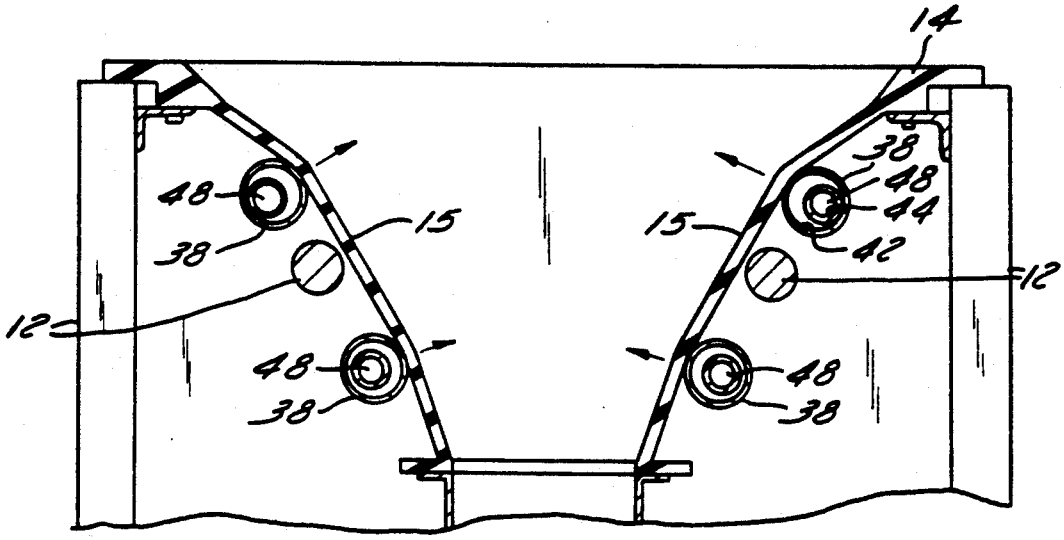
FIG. 3 is a cross sectional view of the roller assemblies shown in abutting relation to the sides of the hopper.
Figure 4:
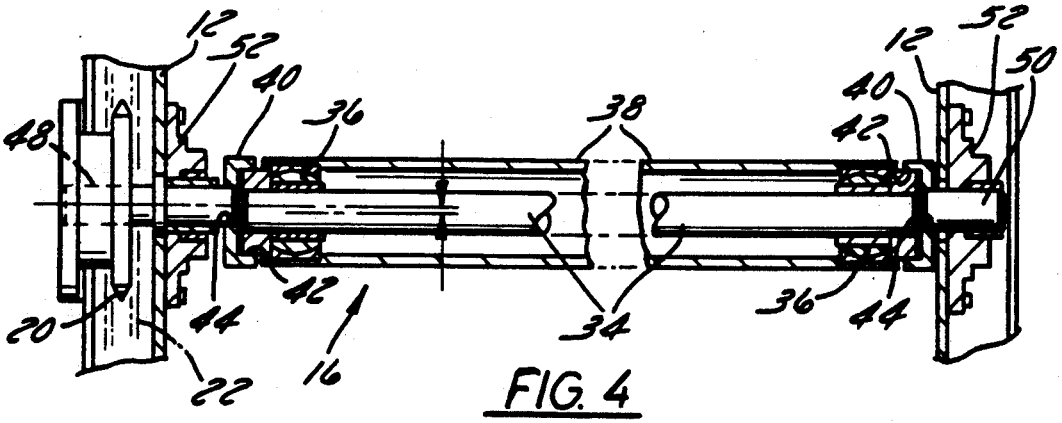
FIG. 4 is a cross sectional view of one of the eccentrically mounted rollers.

Referring to FIG. 2 four roller assemblies 16 are shown mounted in a parallel relation in the frame 12. Two roller assemblies 16 are provided on each side of the hopper. It should be noted that the two roller assemblies on each side of the hopper are angled inwardly to correspond to the walls 15 of the hopper 14. Each of the roller assemblies 16 as seen in FIG. 4 generally includes a roller shaft 34 having a bearing 36 mounted on each end. A tubular roller 38 is mounted on the bearings 36 so that the roller 38 is free to rotate with respect to the shaft 34.

The roller assemblies 16 are supported by eccentric end caps 40 mounted on each end of roller shaft 34. The eccentric caps 40 are mounted on stub shafts 48 and 50 in the frame 12. It should be noted that the axis of the roller shaft 34 is offset from the axes of shafts 48 and 50 to provide relative motion between the roller assemblies 16 and the walls 15 of the hopper 12. For example, the relative motion may cause intermittent engagement of, or cyclic pressure variation between, assemblies 16 and walls 15. It should be noted that the caps 40 include a recess 42 and an opening 44 which is offset from the axis of the recess 42 to provide eccentric motion of the roller assemblies 16. The caps 40 are mounted on shafts 48 and 50 which are journaled in bearing housings 52. The shafts 48 and 50 are aligned with the openings 44 and are permanently secured to the shafts 48 and 50. A sprocket 20 is mounted on each shaft 48.

The roller assemblies 16 are simultaneously driven by means of a chain 22 which is mounted on each of the sprockets 20. An adjustable idler sprocket 24 is provided for maintaining tension in the chain 22. The roller assemblies 16 are driven by a variable speed motor 26 having a drive sprocket 28 which is connected to a driven sprocket 30 mounted on one of the shafts 48 by a chain 32. An idler sprocket 35 may be provided to maintain tension in the chain 32. Motor 26 may be supplied power via a motor drive (not shown) which provides selectability for the speed of motor 12.

In operation, the roller shaft rotates about the axis of the drive shaft 48, moving the roller 38 into engagement with the side wall of the hopper 14. As the roller engages the side wall it is free to rotate on the shaft 34 at the same time as the roller pushes the side wall of the hopper inwardly to break up the granular material sliding down the side wall.

In order to vary the force exerted by the roller assemblies on the side wall of the hopper, the bearing housings 52 may be mounted in slots provided in the frame 12. The drive shaft bearing assembly can then be adjusted so that the roller assembly is moved toward or away from the side wall to vary the force of agitation applied to the side wall.

Thus, it should be apparent that there has been provided in accordance with the present invention a feed hopper agitator that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A feed hopper assembly for feeding granular material to a feed screw at the bottom of a hopper, the assembly including a frame, a resilient hopper mounted in said frame and a roller assembly positioned to engage one of the side walls of the hopper, said roller assembly comprising a shaft, a tubular roller mounted for rotation on the shaft and an eccentric drive assembly for rotating said roller assembly relative to the side wall of the hopper to thereby flex the side wall of the hopper to break up the granular material.

2. The feed hopper assembly according to claim 1 including a roller assembly mounted in the frame in a position to engage the other side wall.

3. The feed hopper assembly according to claim 2 wherein said roller assemblies are interconnected to rotate simultaneously.

4. The feed hopper assembly according to claim 3 including a second roller assembly on each side of the hopper positioned to engage the side walls of the hopper.

5. The feed hopper according to claim 4 wherein said second roller assemblies are interconnected with the roller assemblies on each side of the hopper to rotate simultaneously.

6. A feed hopper assembly of the type including a frame and a flexible hopper mounted in the frame for feeding granular material to a feed screw at the bottom of the hopper, the improvement comprising a number of roller assemblies mounted on the frame on each side of the hopper, each roller assembly including a shaft, a tube mounted for rotary motion on said shaft and an eccentric cap mounted on each end of said shaft and means for rotating said eccentric caps simultaneously whereby each of said roller assemblies are rotated relative to the side walls of the hopper.

7. The assembly according to claim 6 wherein two roller assemblies are mounted on each side of the hopper.

8. The assembly according to claim 7 including means for driving said roller assemblies simultaneously.

9. An agitator for a flexible feed hopper, said agitator including a frame for supporting the feed hopper, a pair of stub shafts mounted on said frame, a roller assembly supported by said stub shafts in a position to engage the side wall of the feed hopper, said roller assembly including a cap mounted on each stub shaft, a shaft supported by said caps in an offset relation to said stub shafts and a tube mounted for rotary motion on said shaft, and means for rotating said stub shafts relative to the feed hopper whereby said tube flexes the side wall of the feed hopper.

10. The agitator according to claim 9 including a second roller assembly mounted on said frame in a position to engage the other side of the feed hopper, said rotating means being operatively connected to rotate both of said roller assemblies.

* * * * *